United States Patent [19]

Kopp et al.

[11] Patent Number: 4,967,826

[45] Date of Patent: Nov. 6, 1990

[54] PROCESS FOR PRODUCING METAL PARTS

[75] Inventors: Reiner Kopp; Klaus R. Baldner, both of Aachen; Klaus Welschof, Meinerzhagen, all of Fed. Rep. of Germany

[73] Assignee: Mannesmann Demag Aktiengesellschaft, Duisburg, Fed. Rep. of Germany

[21] Appl. No.: 399,559

[22] PCT Filed: Feb. 11, 1988

[86] PCT No.: PCT/DE88/00060

§ 371 Date: Oct. 4, 1989

§ 102(e) Date: Oct. 4, 1989

[87] PCT Pub. No.: WO88/06067

PCT Pub. Date: Aug. 25, 1988

[30] Foreign Application Priority Data

Feb. 13, 1987 [DE] Fed. Rep. of Germany ..... 3704457

[51] Int. Cl.[5] ..... B22D 18/02

[52] U.S. Cl. ..... 164/76.1; 164/120

[58] Field of Search ..... 164/120, 319, 320, 321, 164/113, 76.1

[56] References Cited

U.S. PATENT DOCUMENTS 2,233,057 2/1941 Luce ..... 164/319

2,716,792 9/1955 Krøyer ..... 164/120

FOREIGN PATENT DOCUMENTS 56-68576 6/1981 Japan ..... 164/97

55136488 4/1982 Japan ..... 164/120

161100 6/1964 U.S.S.R. ..... 164/319

320337 3/1972 U.S.S.R. ..... 164/319

*Primary Examiner*—Richard K. Seidel

*Assistant Examiner*—Rex E. Pelto

*Attorney, Agent, or Firm*—Fleit, Jacobson, Cohn, Price, Holman & Stern

[57] ABSTRACT

A process for producing metal parts in accordance with the principle of squeeze or forge casting wherein a permanent mold (2) is provided having a mold cavity, a seal (4) is placed on an upper edge flange (5) of the mold surrounding the cavity opening (6), liquid metal (9) is introduced into the cavity, an upper die (3) is inserted (7) into the cavity such that the level of the liquid metal is raised until the higher-level cavity created by the seal (4) is filled, the metal is at least partially solidified, and the final shape of the part is produced by pressing (9) in the upper die, with deformation and spreading of the seal. The result is a completely dense workpiece of excellent dimensional stability which has the texture of a forged part and is correspondingly of very high strength.

10 Claims, 1 Drawing Sheet

PROCESS FOR PRODUCING METAL PARTS

BACKGROUND OF THE INVENTION

1. Field of the Invention

The invention relates to a process for producing metal parts in accordance with the principle of squeeze, or forge, casting approximately the amount of liquid metal required for one part being introduced into a permanent mold and being displaced therein by means of an upper die with the part to be produced being formed.

2. Prior Art

Such processes have numerous advantages because of the combination of casting and pressing, reported on by J. R. Franklin and A. A. Das in "Squeeze casting—a review of the status", British Foundryman", No. 3, 1977, 1984, pages 150 to 152. In principle, these processes provide for the liquid metal, once introduced into the usually preheated permanent mold, to undergo a slight cooling before the upper die is introduced. During this process the liquid metal is displaced, any solidification thereof in the mold being avoided until the final forming of the part is complete. The lowering-in pressure is then maintained while the liquid metal solidifies, after which the upper die is withdrawn and the part removed from the mold. Maintenance of the pressure during solidification allows good filling of the mold while avoiding shrinkage or blowholes and gas pockets. However, the structure does not differ substantially from the cast structure.

BRIEF SUMMARY OF THE INVENTION

Taking this as a starting point, the invention is based on the object of further developing the process based on this generic type such that parts having the properties of forged parts can be produced. In particular, these parts are not only to have a good dimensional stability and dense structure but at the same time are to be characterized by the transformation of the cast structure into a forged structure which is characteristic of forging. Compared with a forging process, however, the structure is to be denser and a considerable reduction in the process time is to be achieved.

This object is achieved in the invention by the process wherein a permanent mold lower die having a mold cavity and a movable upper die having a part insertable into the cavity are provided, a deformable seal is positioned on a flanged surface of the lower die surrounding the mold cavity and effectively increasing the depth thereof, liquid metal is introduced into the cavity in an amount sufficient for forming one metal part but only partially filling the mold cavity below the flange and seal, the insertable part of the upper die is inserted into the mold cavity to displace the liquid metal to fill the cavity substantially to the height of the seal, the liquid metal is allowed to at least partially solidify and pressure is applied so the upper die can deform the metal to the final shape and deform and spread the seal. Compared with a conventional forging process, in which the starting point is a cast, solidified and then re-heated workpiece, there is the advantage that a completely dense structure is arrived at. Unlike the principle of squeeze casting taken as a generic basis, there is the advantage of arriving at a structure which has a forged texture and which consequently makes possible a high degree of mechanical strength in the part produced.

The dimensional stability is also improved, particularly in that the hot-plastic metal is subjected to reshaping.

The seal which is provided neither in squeeze casting nor in the conventional forging process must allow an expansion in respect of the strength of the permanent mold and of the upper die and in respect of the pressures and temperatures used, such that the structure is reliably compressed. Thus copper or a copper alloy proves particularly advantageous for this purpose. If, for example, workpieces of an aluminum forging alloy are to be produced, the material used for the permanent mold and the upper die is a known heat-resistant steel.

In accordance with this example, the metal to be processed, the permanent mold with the upper die and the seal must each be matched to one another from the point of view of their material, so that the transition of shape and temperature caused by the behavior of the said materials is not impaired. The metal provided for the seal must on the one hand behave plastically under the effect of the pressure arising when the upper die is squeezed in, while on the other hand it must not be broken up or etched by the previously liquid metal. However, it is quite useful if the metal of the seal enters into heat exchange with the liquid metal so that the former is for its part heated and thus becomes more easily deformable.

It is furthermore of considerable significance for carrying out the invention that, the upper die is lowered into the cavity but with only sufficient pressure so that the liquid metal fills the permanent mold cavity to about the height of the seal and the liquid metal is not subjected to additional pressure. This in particular prevents metal from emerging between the seal and the edge flange of the permanent mold. Pressure is thus only exerted once the liquid metal has begun to solidify.

BRIEF DESCRIPTION OF THE DRAWINGS

The invention will now be described in detail with reference to the accompanying drawings wherein.

DETAILED DESCRIPTION

Figure 1:
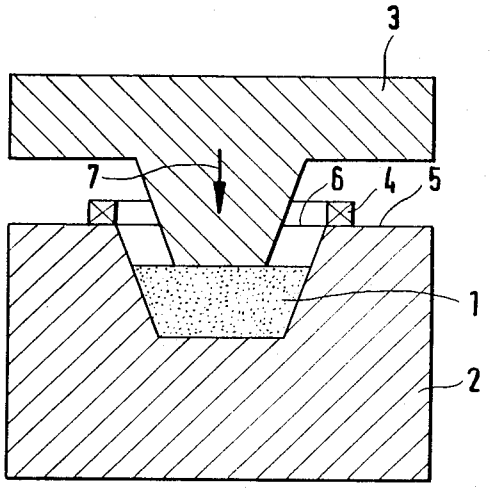
FIG. 1 is a cross-sectional view which shows the permanent mold, charged with liquid metal, with the upper die not yet introduced into the liquid metal.

The permanent mold designated 2 in FIG. 1 is filled to a height of approximately $\frac{2}{3}$ of its cavity with liquid metal 1. The temperature loss and the solidification of the liquid metal can be largely controlled in that the permanent mold 2 is either preheated or cooled. Means known to the person skilled in the art are available in both cases.

There can furthermore be seen the upper plane edge flange 5 of the permanent mold, on which the seal 4 lies such that it surrounds the permanent mold opening 6.

Once the liquid metal 1 has been introduced, the upper die 3 is lowered in the direction of the arrow 7. This process takes place such that the upper die 3 first takes up the position reproduced in FIG. 2 and stops in this position. Here, the liquid metal 1 is displaced such that it enters the permanent mold cavity to the height of the seal 4 but, being at the same time under negligible pressure sufficient only to cause it to fill the cavity. In this state, the edge flange 8 of the upper die 3 parallel to the permanent mold flange 5 comes to rest on the upper edge of the seal 4. The amount of liquid metal introduced and the displacement volume of the upper die 3 consequently need to be carefully matched to one another in such a way that the situation can be reliably prevented in which more liquid metal is displaced by the upper die than can be received by the remaining permanent mold cavity including its raised level. This prevents liquid metal from being squeezed out over the edge of the seal 4 when the upper die is lowered, while as a result of the pressureless or almost pressureless state at the lower edge of the seal 4 it cannot emerge there either.

Figure 2:
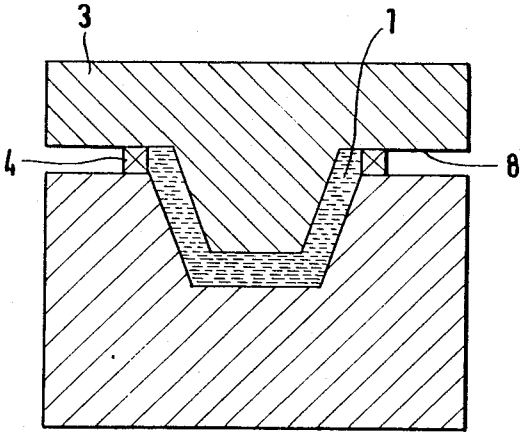
FIG. 2 is a view similar to FIG. 1 which shows the permanent mold with liquid metal partially displaced by the upper die.

The upper die is introduced to an extent in accordance with FIG. 2 and is then held there until the liquid metal has begun to solidify. FIG. 2 illustrates this state by a diagrammatically indicated directional structure.

Figure 3:
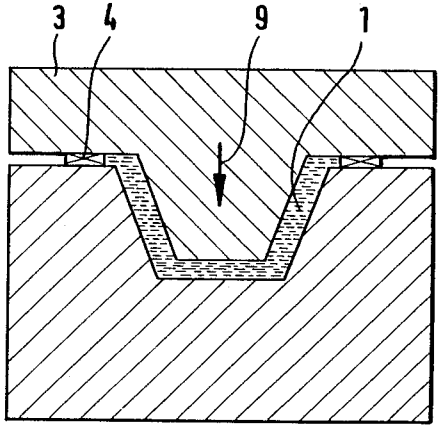
FIG. 3 is a view similar to FIG. 1 which shows the reshaping of the introduced metal after it solidification.

Once solidification has taken place, the upper die 3 is pressed in in the direction of the arrow 9, as shown by FIG. 3. The previously solidified metal 1 now undergoes a deformation so that it is also displaced in the horizontal direction over the opening edge 6 of the permanent mold, the wall thickness decreasing at the same time. In the course of this deformation the seal 4 is spread such that it is pressed flat. Since the point in time of pressing in the upper die 3 can be matched very precisely to the point in time of solidification, blowholes, cavities in the mold and the like can be prevented by corresponding exertion of the squeezing, or forging pressure. The danger of the formation of blowholes or other cavities is in any case greatly reduced because the preadjustment of the upper die in accordance with FIG. 2 brings about a reduction of the wall thickness of the still liquid metal so that the faults of the type mentioned, frequently occurring with relatively large cohesive volumes, are virtually eliminated. The important feature is thus that the lowering in of the upper die, which is still virtually pressureless, is carried out such that the wall thickness of the remaining permanent mold cavity to be filled with liquid metal is reduced.

The expression "solidification" of the liquid metal used above does not necessarily indicate the occurrence of a total solidification of the liquid metal. It is sufficient if an edge region of the metal of considerable proportional thickness has solidified, while the core may still be liquid at the start of deformation, to be also solidified at the end of the deformation process. Thus, the solidification can first be limited to the edge cross section which leaves free a core which may still be sensitive as regards the formation of blowholes, which however may not arise once deformation has begun. In the manner already described, the point in time of pressing in the upper die 3 is consequently matched to a point in time in solidification at which it is therefore not absolutely necessary that the end of solidification has occurred.

I claim:

1. A forge casting process for producing a metal part comprising:

providing a permanent mold lower die having a mold cavity, and an upper plane edge flange;

providing an upper die having a part insertable into the mold cavity of the lower die;

providing a deformable seal on the upper plane edge flange surrounding the opening of the mold cavity and effectively increasing the depth thereof;

introducing into the mold cavity an approximate amount of liquid metal required for one metal part to be formed and to partially fill the mold cavity so that the level thereof is below the upper plane edge flange;

inserting the insertable part of the upper die into the mold cavity of the lower die so that said liquid metal is displaced to fill the mold cavity beyond the opening of the mold cavity to substantially the increased depth produced by the seal;

solidifying the liquid metal; and, applying pressure to the upper die to deform the metal to the final shape and deform and spread the seal.

2. The process as claimed in claim 1 wherein:

an edge flange is provided on the upper die substantially parallel to the upper plane edge flange of the lower die; and, the seal is pressed substantially flat between the upper plane edge flange on the lower die and the edge flange on the upper die.

3. The process as claimed in claim 1 wherein the seal is made of a material selected from the group consisting of copper and copper alloys.

4. The process as claimed in claim 1 wherein after the step of inserting the upper die into the mold cavity only sufficient pressure is applied on said liquid metal to cause said liquid metal to be displaced so that the liquid metal is under substantially negligible pressure.

5. A forge casting process for producing a metal part comprising:

providing a permanent mold lower die having a mold cavity, and an upper plane edge flange;

providing an upper die having a part insertable into the mold cavity of the lower die;

providing a deformable seal on the upper plane edge flange surrounding the opening of the mold cavity and effectively increasing the depth thereof;

introducing into the mold cavity an approximate amount of liquid metal required for one metal part to be formed and to partially fill the mold cavity so that the level thereof is below the upper plane edge flange;

inserting the insertable part of the upper die into the mold cavity of the lower die so that said liquid metal is displaced to fill the mold cavity beyond the opening of the mold cavity to substantially the increased depth produced by the seal;

at least partly solidifying the liquid metal to the point where at least part of the metal is still in the hot-plastic condition; and, applying pressure to the upper die to deform the metal to the final shape and deform and spread the seal.

6. The process as claimed in claim 5 wherein:

an edge flange is provided on the upper die substantially parallel to the upper plane edge flange of the lower die; and, the seal is pressed substantially flat between the upper plane edge flange on the lower die and the edge flange on the upper die.

7. The process as claimed in claim 6 wherein the seal is made of a material selected from the group consisting of copper and copper alloys.

8. The process as claimed in claim 7 wherein after the step of inserting the upper die into the mold cavity only sufficient pressure is applied on said liquid metal to cause said liquid metal to be displaced so that the liquid metal is under substantially negligible.

9. The process as claimed in claim 5 wherein the seal is made of a material selected from the group consisting of copper and copper alloys.

10. The process as claimed in claim 5 wherein after the step of inserting the upper die into the mold cavity only sufficient pressure is applied on said liquid metal to cause said liquid metal to be displaced so that the liquid metal is under substantially negligible pressure.

* * * * *